US006339367B1

(12) United States Patent
Takehana

(10) Patent No.: US 6,339,367 B1
(45) Date of Patent: Jan. 15, 2002

(54) LAMINATED CHIP TYPE VARISTOR

(75) Inventor: Makikazu Takehana, Akita (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/534,337

(22) Filed: Mar. 24, 2000

(30) Foreign Application Priority Data

Mar. 26, 1999 (JP) ..... 11-083238

(51) Int. Cl.[7] ..... H01C 7/10
(52) U.S. Cl. ..... 338/20; 338/21
(58) Field of Search ..... 338/21, 22 R, 338/309, 20

(56) References Cited

U.S. PATENT DOCUMENTS 4,290,041 A * 9/1981 Utsumi et al. ..... 338/21
5,369,390 A * 11/1994 Lin et al. ..... 338/21
5,973,589 A * 10/1999 Wu et al. ..... 338/21
6,160,472 A * 12/2000 Arashi et al. ..... 338/21

FOREIGN PATENT DOCUMENTS

JP 3-278404 12/1991
JP 405036566 A * 2/1993
JP 5-129104 5/1993
JP 7-201531 8/1995
JP 11026209 A * 7/1997

* cited by examiner

*Primary Examiner*—Karl D. Easthom
*Assistant Examiner*—Kyung S. Lee
(74) *Attorney, Agent, or Firm*—Oblon, Spivak, McClelland, Maier & Neustadt, P.C.

(57) ABSTRACT

A laminated chip type varistor comprising a varistor function layer, internal electrodes, and terminal electrodes. The varistor function layer has a composition containing zinc oxide as a main component, and cobalt oxide and rare earth elements as additives. The internal electrodes contain at least one selected from the group consisting of aluminum in the form of $Al_2O_3$ with an amount of from 0.0001 to 5.0% by weight, iron in the form of $Fe_2O_3$ with an amount of from 0.0001 to 5.0% by weight, and zirconia in the form of $ZrO_2$ with an amount of from 0.001 to 6.0% by weight as additives with respect to an electrically conductive metal component of a composition for forming layers of the internal electrodes.

21 Claims, 1 Drawing Sheet

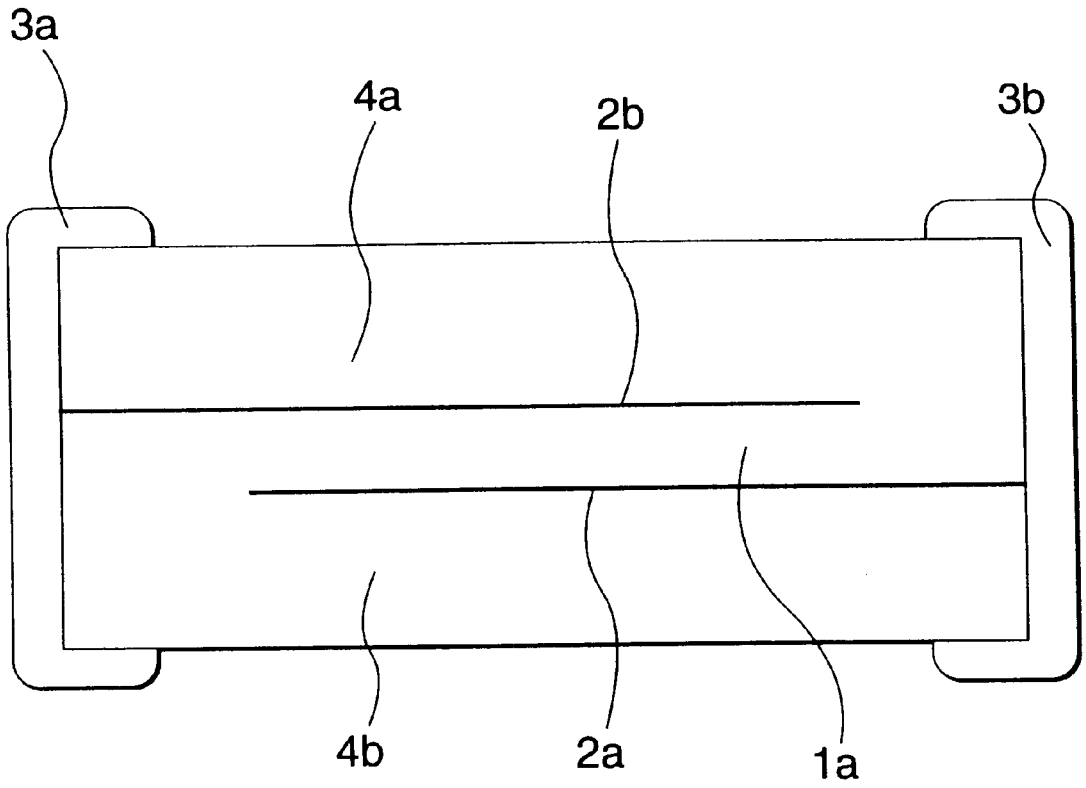
3a
4a
2b
3b
4b
2a
1a

LAMINATED CHIP TYPE VARISTOR

BACKGROUND OF THE INVENTION

1. Field of the Invention

The present invention relates to a voltage nonlinear resistor for use for stabilization of circuit voltages in various kinds of electronic appliances, for absorbing surge, noise, etc., and particularly relates to a voltage nonlinear resistor in which the leakage current after the resistor is soldered to a substrate is reduced without changing the varistor function from that of a conventional one.

2. Description of the Related Art

Zinc oxide varistors have been heretofore widely used in household electric appliances, and so on, because of its excellent nonlinear characteristic and its excellent energy characteristic. The zinc oxide varistors have been also widely used for other purposes recently because attention has been paid to the use of zinc oxide varistors as laminated chip varistors of the type embedded in a surface as parts for countermeasures to noise and static electricity. Further, their terminal electrodes have been plated in order to improve solderability.

In the existing circumstances, although the leakage current at the time of application of a circuit voltage to each a single part has caused no problem, but there was a problem in that the leakage current at the time of application of a circuit voltage after soldering to a substrate has increased. For example, a device actuated by a battery had a disadvantage in that the operating time was shortened.

This was because a portion of low resistance was generated in a surface of the laminated chip varistor when soldering was carried out. A method of coating a surface of a base with glass or epoxy resin (JP-A-5-129104) is known as a countermeasure to this problem.

It is also known that the leakage current after soldering is reduced by reducing the amount of an additive such as aluminum added to a varistor composition. In this case, however, the nonlinear index ($\alpha$) as a varistor characteristic was so small that the varistor could not be generally used as a surge and noise absorptive protection device easily.

In the aforementioned method of coating a surface of a base with glass or epoxy resin in order to reduce the leakage current after soldering, work was complicated, and the reduction in yield, the failure in soldering, or the like, was caused because of coating of unnecessary portions. There was, therefore, a problem in lowering of reliability and in increase of cost.

Further, when leakage current was to be reduced due to the amount of addition of aluminum oxide, the nonlinear index ($\alpha$) could be set at a sufficient value by increasing the amount of addition of aluminum oxide, but, in this case, there was a problem that the leakage current was increased conversely.

SUMMARY OF THE INVENTION

Accordingly, an object of the present invention is to provide a laminated chip type varistor improved in the aforementioned problems.

To achieve the foregoing object, the present invention provides laminated chip type varistors having the following configurations.

A laminated chip type varistor including a varistor function layer, internal electrodes, and terminal electrodes, wherein: the varistor function layer has a composition containing zinc oxide as a main component, and cobalt oxide and rare earth elements as additives; and the internal electrodes contain at least one member selected from the group consisting of aluminum in the form of $Al_2O_3$ with an amount of from 0.0001 to 5.0% by weight, iron in the form of $Fe_2O_3$ with an amount of from 0.0001 to 5.0% by weight, and zirconia in the form of $ZrO_2$ with an amount of from 0.001 to 6.0% by weight as additives with respect to an electrically conductive metal component of a composition for forming layers of the internal electrodes.

It is more preferable that a laminated chip type varistor comprising a varistor function layer, internal electrodes, and terminal electrodes, wherein: the varistor function layer has a composition containing zinc oxide as a main component, and cobalt oxide and rare earth elements as additives; and the internal electrodes contain at least one member selected from the group consisting of aluminum in the form of $Al_2O_3$ with an amount of from 0.0001 to 0.5% by weight, iron in the form of $Fe_2O_3$ with an amount of from 0.0001 to 0.5% by weight, and zirconia in the form of $ZrO_2$ with an amount of from 0.001 to 0.5% by weight as additives with respect to an electrically conductive metal component of a composition for forming layers of the internal electrodes.

With such a configuration, laminated chip type varistors having the following effects can be provided.

(1) The leakage current after soldering can be a small value which is not larger than 7.5 $\mu$A without lowering the varistor function.

(2) The leakage current after soldering can be a further smaller value which is not larger than 7 $\mu$A without lowering the varistor function.

BRIEF DESCRIPTION OF THE DRAWINGS

FIG. 1 shows a section of a laminated chip varistor configured according to the present invention.

DETAILED DESCRIPTION OF THE PREFERRED EMBODIMENTS

Embodiments of the present invention will be described with reference to FIG. 1. In FIG. 1, the reference numeral 1*a* designates a varistor layer; 2*a* and 2*b*, internal electrodes; 3*a* and 3*b*, terminal electrodes; and 4*a* and 4*b*, protective layers.

In order to form the varistor layer, first, an organic binder, an organic solvent and an organic plasticizer were added to $ZnO—CoO—Pr_2O_{3.67}—Al_2O_3$ powder having a composition shown in Table 1 and then those materials were mixed and crushed in a ball mill for 20 hours, so that a varistor function slurry was prepared.

TABLE 1

| Sample | Varistor Porcelain Composition (mol %) | | | | Additives in Internal Electrode Electrically Conductive Metal (wt %) | | | at Single Product | | | | after Soldering to Substrate | |
|---|---|---|---|---|---|---|---|---|---|---|---|---|---|
| | | | | | | | | Varistor Voltage | Nonlinear Index | Leakage Current | in Terms of Resistance | Leakage Current | in Terms of Resistance |
| No. | ZnO | CoO | $Pr_2O_{3.67}$ | $Al_2O_3$ | $Al_2O_3$ | $Fe_2O_3$ | $ZrO_2$ | (V) | (α) | (μA) | (MΩ) | (μA) | (MΩ) |
| 1 | 97.799 | 1.5 | 0.7 | 0.001 | 0 | 0 | 0 | 27 | 9 | 0.015 | 19.60 | 1 | 11.34 |
| 2 | 97.796 | 1.5 | 0.7 | 0.004 | 0 | 0 | 0 | 27 | 24 | 0.0215 | 13.67 | 20 | 0.57 |
| 3 | 97.799 | 1.5 | 0.7 | 0.001 | 0.0001 | 0 | 0 | 27 | 15 | 0.021 | 14.00 | 1 | 11.34 |
| 4 | 97.799 | 1.5 | 0.7 | 0.001 | 0.05 | 0 | 0 | 27 | 22 | 0.0215 | 13.67 | 1.8 | 6.30 |
| 5 | 97.799 | 1.5 | 0.7 | 0.001 | 0.115 | 0 | 0 | 27 | 24 | 0.022 | 13.36 | 2 | 5.67 |
| 6 | 97.799 | 1.5 | 0.7 | 0.001 | 0.5 | 0 | 0 | 27 | 24 | 0.022 | 13.36 | 2.2 | 5.15 |
| 7 | 97.799 | 1.5 | 0.7 | 0.001 | 5 | 0 | 0 | 27 | 24 | 0.023 | 12.78 | 7.5 | 1.51 |
| 8 | 97.799 | 1.5 | 0.7 | 0.001 | 5.1 | 0 | 0 | Unmeasurable because of Unsinterability | | | | | |
| 9 | 97.799 | 1.5 | 0.7 | 0.001 | 0 | 0.0001 | 0 | 27 | 14 | 0.021 | 14.00 | 1 | 11.34 |
| 10 | 97.799 | 1.5 | 0.7 | 0.001 | 0 | 0.05 | 0 | 27 | 22 | 0.0215 | 13.67 | 1.8 | 6.30 |
| 11 | 97.799 | 1.5 | 0.7 | 0.001 | 0 | 0.115 | 0 | 27 | 24 | 0.022 | 13.36 | 2 | 5.67 |
| 12 | 97.799 | 1.5 | 0.7 | 0.001 | 0 | 0.5 | 0 | 27 | 24 | 0.022 | 13.36 | 2.2 | 5.15 |
| 13 | 97.799 | 1.5 | 0.7 | 0.001 | 0 | 5 | 0 | 27 | 24 | 0.023 | 12.78 | 7.5 | 1.51 |
| 14 | 97.799 | 1.5 | 0.7 | 0.001 | 0 | 5.1 | 0 | Unmeasurable because of Unsinterability | | | | | |
| 15 | 97.799 | 1.5 | 0.7 | 0.001 | 0 | 0 | 0.001 | 27 | 13 | 0.021 | 14.00 | 1 | 11.34 |
| 16 | 97.799 | 1.5 | 0.7 | 0.001 | 0 | 0 | 0.5 | 27 | 22 | 0.0215 | 13.67 | 1.8 | 6.30 |
| 17 | 97.799 | 1.5 | 0.7 | 0.001 | 0 | 0 | 0.115 | 27 | 24 | 0.022 | 13.36 | 2 | 5.67 |
| 18 | 97.799 | 1.5 | 0.7 | 0.001 | 0 | 0 | 0.5 | 27 | 24 | 0.022 | 13.36 | 2.2 | 5.15 |
| 19 | 97.799 | 1.5 | 0.7 | 0.001 | 0 | 0 | 6 | 27 | 24 | 0.023 | 12.78 | 7.5 | 1.51 |
| 20 | 97.799 | 1.5 | 0.7 | 0.001 | 0 | 0 | 6.1 | Unmeasurable because of Unsinterability | | | | | |
| 21 | 97.799 | 1.5 | 0.7 | 0.001 | 0.3 | 0.5 | 0.3 | 27 | 21 | 0.023 | 12.78 | 6.5 | 1.74 |
| 22 | 97.799 | 1.5 | 0.7 | 0.001 | 0.3 | 0.5 | 0.3 | 27 | 23 | 0.0235 | 12.51 | 5 | 2.27 |
| 23 | 97.799 | 1.5 | 0.7 | 0.001 | 0.4 | 0.4 | 0.2 | 27 | 28 | 0.024 | 12.25 | 7 | 1.62 |

This slurry was applied onto a base film of PET (polyethylene terephthalate) by a doctor blade method so that a 30 μA m-thick varistor function green sheet serving as a protective layer 4*b* shown in FIG. 1 was prepared. An electrically conductive paste containing palladium as a main electrically conductive metal component, and additives such as $Al_2O_3$, $Fe_2O_3$ and $ZrO_2$ shown in Table 1 was printed by a screen printing method on the varistor function green sheet which was formed by the aforementioned application. Then, the green sheet was dried into a desired shape so that an internal electrode 2*a* shown in FIG. 1 was formed.

Then, the aforementioned varistor function slurry to be formed into a varistor layer 1*a* shown in FIG. 1 was applied in the same manner as in the aforementioned application so that a varistor function green sheet shown in FIG. 1 was formed. Then, an internal electrode 2*b* shown in FIG. 1 was formed in the same manner as described above.

A varistor function green sheet serving as a protective layer 4*a* which was the outermost layer of the internal electrode 2*b* was formed by laminating a plurality of green sheets of the same composition type so that the distance between the internal electrode 2*b* and the surface of the outermost layer thereof was set to be larger than the distance between the internal electrodes 2*a* and 2*b*. Of course, the distance between the internal electrode 2*a* and the surface of the protective layer 4*b* which was the outermost layer of the internal electrode 2*a* was also set to be larger than the distance between the internal electrodes 2*a* and 2*b* in the same manner as described above.

Incidentally, platinum, or the like, other than palladium may be preferably used as the main electrically conductive metal component of the electrically conductive paste for forming the internal electrodes 2*a* and 2*b*.

Further, electrodes containing $Al_2O_3$, $Fe_2O_3$ and $ZrO_2$ as additives in weight % proportion in each of sample Nos. 1 to 23 shown in Table 1 were used as the internal electrodes 2*a* and 2*b*.

Then, the varistor function green sheet serving as the protective layer 4*b*, the varistor function green sheet serving as a combination of the internal electrode 2*a* and the varistor layer 1*a*, and the varistor function green sheet serving as a combination of the internal electrode 2*b* and the protective layer 4*a* were heated, press-bonded to one another and then cut into a predetermined chip shape to thereby form a green chip.

After the binder was removed from the green chip under the condition of 350° C. and 2 hours, the green chip was baked in air in a temperature range of from 1100° C. to 1250° C. for 2hours so that a baked product as a varistor material was obtained.

Then, an electrode paste containing Ag as a main component was applied on opposite end portions of the varistor material and baked at 800° C. so that terminal electrodes 3*a* and 3*b* shown in FIG. 1 were formed. Thus, a laminated chip varistor was produced.

Incidentally, the internal electrodes were provided as two layers, between which the overlap area S was set at S=0.83 $mm^2$. The thickness of the varistor layer, that is, the thickness of the varistor layer between the internal electrodes 2*a* and 2*b* was 60 μm. The shape of the laminated chip varistor was as follows. A length L was 1.6 mm, a width W was 0.8 mm, and a height H was 0.8 mm. FIG. 1 shows a section of the laminated chip varistor.

As described above, electrodes containing palladium as a main electrically conductive metal component and containing $Al_2O_3$, $Fe_2O_3$ and $ZrO_2$ as additives in weight % proportion described in each of sample Nos. 1 to 23 shown in Table 1 were used as the internal electrodes 2*a* and 2*b* of the laminated chip varistor.

The detailed characteristic of the aforementioned laminated chip varistor will be described.

A nonlinear index α as an electric characteristic, which expressed the relation between current and voltage applied between opposite ends of the varistor when the current flowing in the varistor is changed from 1 mA to 10 mA with respect to the varistor voltage (V1 mA), that is, the voltage applied between opposite ends of the varistor when a current of 1 mA flowed in the varistor, was given by the following equation (1). Here, V10 mA was a voltage applied between opposite ends of the varistor when the current flowing in the varistor was 10 mA.

Equation 1

$$\alpha = \frac{\log(10/1)}{\log(V10mA/V1mA)} \quad (1)$$

The larger the nonlinear index α becomes, the more suddenly the reduction in resistance of the varistor itself occurs. As a result, it is possible to remove surge voltage or noise sufficiently. Incidentally, when the varistor is used as a protection device, the nonlinear index α generally needs to be not smaller than 10.

Then, copper lands each having 1 mm square were disposed at intervals of 1 mm on a glass-epoxy substrate available in the market. After a solder paste was printed on the lands in advance, laminated chip varistors using internal electrodes each containing palladium as a main electrically conductive metal component, and $Al_2O_3$, $Fe_2O_3$ and $ZrO_2$ as additives in weight % proportion as described in sample Nos. 1 to 23 shown in Table 1 were put on the solder paste-printed lands respectively and soldered in a reflow furnace. After the substrate was cleansed sufficiently to remove flux and then left at room temperature for 1 hour, the leakage current Id and the surface resistance R were measured. A voltage of 27 V, which was the varistor voltage (V1 mA) , was used for the measurement of these values.

Incidentally, it was confirmed that the leakage current in the case where only the glass-epoxy substrate was soldered in the reflow furnace under the same condition was not larger than 0.001 μA (not smaller than 1000 MΩ in terms of resistance value) and that the leakage current in the glass-epoxy substrate itself did not become a subject of discussion. Further, the leakage current Id in a state in which the laminated varistors were not soldered onto the epoxy substrate, that is, in a state in which the laminated varistors were used as single products, was also confirmed.

Here, the surface resistance R is given by the following equation (2).

Equation 2

$$R = \frac{0.42 \times V1mA}{Id} \quad (2)$$

Table 1 shows measured results of electric characteristic of respective sample Nos. obtained in the aforementioned manner. In Table 1, sample Nos. 3 to 7, Nos. 9 to 13, Nos. 15 to 19 and Nos. 21 to 23 are in the scope of the present invention whereas sample Nos. 1, 2, 8, 14 and 20 show comparative examples.

The following results become clear from Table 1.

When the amount of $Al_2O_3$ as an additive in the internal electrode electrically conductive metal composition is smaller than 0.0001% by weight, the nonlinear index α is as small as 9 (sample No. 1).

When the amount of $Al_2O_3$ as an additive in the composition is not larger than 5.0% by weight, the leakage current is also as small as 7.5 μA and useful (sample No. 7). Although the leakage current after soldering is as small as 7.5 μA when the amount of $Al_2O_3$ as an additive is smaller than 5.0% by weight, the leakage current after soldering is large when the amount of $Al_2O_3$ as an additive is not smaller than 5.0% by weight. Accordingly, when $Al_2O_3$ is used as an additive, the samples satisfying the condition of 1 MΩ or larger in terms of insulation resistance are sample Nos. 3 to 7. The amount of $Al_2O_3$ as an additive is preferably set to be in a range of from 0.0001 to 5.0% by weight.

When the amount of $Fe_2O_3$ as an additive in the composition is smaller than 0.0001% by weight, the nonlinear index α becomes not larger than α=9. Although the leakage current after soldering is as small as 7.5 μA when the amount of $Fe_2O_3$ as an additive is smaller than 5.0% by weight, the leakage current after soldering is large when the amount of $Fe_2O_3$ is not smaller than 5.0% by weight. Accordingly, when $Fe_2O_3$ is used as an additive, the samples satisfying the condition of 1 MΩ or larger in terms of insulation resistance are sample Nos. 9 to 13. The amount of $Fe_2O_3$ as an additive is preferably set to be in a range of from 0.0001 to 5.0% by weight.

Similarly, when the amount of $ZrO_2$ as an additive in the composition is smaller than 0.001% by weight, the nonlinear index α becomes a small value not larger than 9. Although the leakage current after soldering is as small as 7.5 μA when the amount of $ZrO_2$ as an additive is smaller than 6.0% by weight, the leakage current after soldering is large when the amount of $ZrO_2$ is not smaller than 6.0% by weight. Accordingly, when $ZrO_2$ is used as an additive, the samples satisfying the condition of 1 MΩ or larger in terms of insulation resistance are sample Nos. 15 to 19. The amount of $ZrO_2$ as an additive is preferably set to be in a range of from 0.001 to 6.0% by weight.

Incidentally, even in the case where two or three members selected from the group consisting of $Al_2O_3$, $Fe_2O_3$ and $ZrO_2$ are used as additives simultaneously, varistors sufficient to stand use as protection devices can be provided in the above region because the leakage current after soldering to the glass-epoxy substrate is not smaller than 1 MΩ in terms of insulation resistance and the nonlinear index α is not smaller than α=10.

Sample Nos. 21 to 23 in Table 1 show the case where the three members $Al_2O_3$, $Fe_2O_3$ and $ZrO_2$ are used as additives simultaneously.

It is apparent from reference to sample Nos. 7, 13 and 19 and Nos. 21 to 23 that varistors which are so excellent in characteristic that the leakage current is reduced to a very small value not larger than 2.2 μA in single use can be provided when the amount of $Al_2O_3$ as an additive is set to be in a range of from 0.0001 to 0.5% by weight, the amount of $Fe_2O_3$ as an additive is set to be in a range of from 0.0001 to 0.5% by weight and the amount of $ZrO_2$ as an additive is set to be in a range of from 0.001 to 0.5% by weight.

Hence, in the present invention, the linear index α can be set at a value sufficient to use the varistor as a protection device because the region surrounded by the internal electrodes contains a large amount of aluminum oxide, or the like, diffused from the internal electrodes. On the other hand, the leakage current can be minimized even after soldering. This is because the laminated chip varistor surface is thicker than the distance between the internal electrodes so that aluminum oxide, or the like, diffused from the internal electrodes is prevented from being dispersed into the laminated chip varistor outermost layer and the laminated chip varistor surface is made relatively hard to pass current.

Although the above description has been made upon the case where palladium is used as a main electrically conductive metal component of the internal electrodes, the present invention is not limited thereto but the same effect as described above can be obtained also in the case where platinum is used.

Although JP-A-3-278404 and JP-A-7-201531 disclose the case where $Al_2O_3$ exists in a resistor for a varistor function, those are different from the present invention because those do not describe the case where $Al_2O_3$ is contained as an additive in internal electrodes.

According to the present invention, the leakage current in a laminated chip varistor soldered to a substrate can be reduced without changing the varistor function from the conventional varistor function. As a result, a voltage non-linear resistor adapted for countermeasures to noise and static electricity can be provided without wasteful electric power consumption of circuits.

While only certain embodiments of the invention have been specifically described herein, it will be apparent that numerous modifications may be made thereto without departing from the spirit and scope of the invention.

The present invention is based on Japanese Patent Application No. Hei. 11-83238 which is incorporated herein by reference.

What is claimed is:

1. A laminated chip type varistor comprising:

a varistor function layer;

internal electrodes; and terminal electrodes, wherein said varistor function layer has a composition containing zinc oxide as a main component, and cobalt oxide and rare earth elements as additives, and wherein said internal electrodes contain at least one additive selected from the group consisting of $Al_2O_3$ in an amount of from 0.0001 to 5.0% by weight, $Fe_2O_3$ in an amount of from 0.0001 to 5.0% by weight, and $ZrO_2$ in an amount of from 0.001 to 6.0% by weight.

2. The laminated chip type varistor according to claim 1, wherein the electrically conductive metal component of said internal electrodes includes palladium as a main component.

3. The laminated chip type varistor according to claim 1, wherein the electrically conductive metal component of said internal electrodes includes platinum as a main component.

4. The laminated chip type varistor according to claim 1, wherein said internal electrodes contain at least one selected from the group consisting of aluminum in the form of $Al_2O_3$ with an amount of from 0.0001 to 0.5% by weight, iron in the form of $Fe_2O_3$ with an amount of from 0.0001 to 0.5% by weight, and zirconia in the form of $ZrO_2$ with an amount of from 0.001 to 0.5% by weight as additives with respect to the electrically conductive metal component of a composition for forming layers of said internal electrodes.

5. The laminated chip type varistor according to claim 4, wherein the electrically conductive metal component of said internal electrodes includes palladium as a main component.

6. The laminated chip type varistor according to claim 4, wherein the electrically conductive metal component of said internal electrodes includes platinum as a main component.

7. The laminated chip type varistor according to claim 1, wherein said internal electrodes contain $Al_2O_3$.

8. The laminated chip type varistor according to claim 7, wherein the electrically conductive metal component of said internal electrodes includes palladium as a main component.

9. The laminated chip type varistor according to claim 7, wherein the electrically conductive metal component of said internal electrodes includes platinum as a main component.

10. The laminated chip type varistor according to claim 1, wherein said internal electrodes contain $Fe_2O_3$.

11. The laminated chip type varistor according to claim 10, wherein the electrically conductive metal component of said internal electrodes includes palladium as a main component.

12. The laminated chip type varistor according to claim 10, wherein the electrically conductive metal component of said internal electrodes includes platinum as a main component.

13. The laminated chip type varistor according to claim 1, wherein said internal electrodes contain $ZrO_2$.

14. The laminated chip type varistor according to claim 13, wherein the electrically conductive metal component of said internal electrodes includes palladium as a main component.

15. The laminated chip type varistor according to claim 13, wherein the electrically conductive metal component of said internal electrodes includes platinum as a main component.

16. A laminated chip type varistor comprising:

a varistor function layer;

internal electrodes; and terminal electrodes, wherein said varistor function layer has a composition containing zinc oxide as a main component, and cobalt oxide and rare earth elements as additives, and wherein said internal electrodes contain at least one additive selected from the group consisting of $Al_2O_3$ in an amount of from 0.0001 to 5.0% by weight, $Fe_2O_3$ in an amount of from 0.0001 to 5.0% by weight, and $ZrO_2$ in an amount of from 0.001 to 6.0% by weight, wherein said internal electrodes contain $Al_2O_3$, $Fe_2O_3$, and $ZrO_2$.

17. The laminated chip type varistor according to claim 16, wherein the electrically conductive metal component of said internal electrodes includes palladium as a main component.

18. The laminated chip type varistor according to claim 16, wherein the electrically conductive metal component of said internal electrodes includes platinum as a main component.

19. A laminated chip type varistor comprising:

a varistor function layer;

internal electrodes; and terminal electrodes, wherein said varistor function layer has a composition containing zinc oxide as a main component, and cobalt oxide and rare earth elements as additives, and wherein said internal electrodes contain at least one additive selected from the group consisting of $Al_2O_3$ in an amount of from 0.0001 to 5.0% by weight, $Fe_2O_3$ in an amount of from 0.0001 to 5.0% by weight, and $ZrO_2$ in an amount of from 0.001 to 6.0% by weight, wherein said internal electrodes contain at least two of $Al_2O_3$, $Fe_2O_3$, and $ZrO_2$.

20. The laminated chip type varistor according to claim 19, wherein the electrically conductive metal component of said internal electrodes includes palladium as a main component.

21. The laminated chip type varistor according to claim 19, wherein the electrically conductive metal component of said internal electrodes includes platinum as a main component.

* * * * *